US006394910B1

(12) United States Patent
McCarthy

(10) Patent No.: US 6,394,910 B1
(45) Date of Patent: May 28, 2002

(54) GOLF PUTTER FOR ALIGNING PLAYER'S HEAD

(76) Inventor: Robert McCarthy, 4 Maple Ave., Box 0, Unadilla, NY (US) 13849

( * ) Notice: Subject to any disclaimer, the term of this patent is extended or adjusted under 35 U.S.C. 154(b) by 4 days.

(21) Appl. No.: 09/617,734

(22) Filed: Jul. 17, 2000

(51) Int. Cl.[7] ..... A63B 69/36; A63B 53/04

(52) U.S. Cl. ..... 473/251; 473/252; 473/340; 473/341; 473/338

(58) Field of Search ..... 473/251, 252, 473/253, 254, 250, 238, 268, 324, 334, 340, 338, 313, 314, 341, 242; D21/742, 743, 744, 745, 746; 273/DIG. 14

(56) References Cited

U.S. PATENT DOCUMENTS

D231,624 S * 5/1974 Wilmoth
3,873,094 A * 3/1975 Sebo
3,954,265 A * 5/1976 Taylor
4,222,566 A * 9/1980 Berry
4,324,404 A * 4/1982 Dian
4,369,974 A * 1/1983 Komperda
4,871,174 A * 10/1989 Kobayashi
4,962,931 A * 10/1990 Jazdzyk
5,324,031 A * 6/1994 Green
5,580,058 A * 12/1996 Coughlin
5,984,800 A * 11/1999 Uebelhor
6,039,657 A * 3/2000 Gidney

* cited by examiner

*Primary Examiner*—Sebastiano Passaniti
(74) *Attorney, Agent, or Firm*—Salzman & Levy

(57) ABSTRACT

A golf putter is described whose club head has visual indicator guides for aligning the golfer's head relative to the club head, the ball, and the cup of the putting green. The visual indicator guides are provided by distinguishable, colored surfaces of the club head that project the appearance of two alignment lines to the eye of the golfer, despite the fact that no actual markings exist. Thus, the indicator lines provide a head alignment aid, while conforming to USGA rules.

9 Claims, 5 Drawing Sheets

GOLF PUTTER FOR ALIGNING PLAYER'S HEAD

FIELD OF THE INVENTION

The present invention relates to golf putters and, more particularly, to a golf putter that has visual indicator surfaces that, when aligned, provide a means by which the golfer can properly position his or her head with respect to the club face, the ball and the green.

BACKGROUND OF THE INVENTION

Putting is a difficult task at best, and sometimes almost an impossible feat. Every golfer has experienced those days when the ball just does not fall into the cup. It is at these moments that most golfers would wish to have additional help. The present invention seeks to provide a new type of putter that can assist a golfer with his putting game, and provide that added edge.

Every golfer has his favorite putter, which is used to guide the ball into the hole. Putters come in many sizes and shapes to accommodate the individual tastes and preferences of the sports enthusiast.

Golfers usually concentrate upon the break and speed of the green when putting. Their attention is focused mainly upon the trajectory or path that the ball is to travel to the cup. Some golf putters have a line or groove drawn along the center of the top of the club head, in order to provide an indicator that will align the club face with the ball, and point to the direction of the cup. Although this can be a useful visual aid, such golf club markings are often prohibited by rules of golf associations, such as the United States Golf Association (USGA).

The present invention reflects the discovery that visual indicators, comprising changes in colored surfaces, can be a substitute for a center line or groove. Fortunately, such a substitute conforms to the USGA rules, as it provides means for the player to align his head, rather than providing an aiming or aligning mechanism, per se.

The current invention consists of a putter club head having concave side surfaces. The lower portion of the club head extends slightly outwardly beyond the upper portion defining the concave arc. The concave surfaces are colored differently from the rest of the club head surfaces. For example, the concave surface can be white, and the other club head surfaces can be a dark color or black. The difference in color contrast is easily distinguishable, and appears to the golfer as line indicators, although there are no actual markings on the club head itself. A golfer standing over the top of the club head visualizes one or more pairs of thinly colored lines along each side of the club head. This is a result of the lower projecting surface. Therefore, although there is no actual marker or groove forming a line, the golfer nonetheless visualizes lines on the sides of the club head to align his head relative to the putting head, the ball, and the cup (hole) of the green.

In addition to providing a visual aid to aligning the player's head with the club face, ball and green, the pairs of lines also provide an additional indicator benefit. Other than positioning oneself directly over the club head, little attention is ever given to whether the club is level with the green. As aforementioned, most golfers concern themselves with the club face, and whether, when addressing the ball, the ball is met perpendicularly with the face of the club head. However, as is commonly known, lifting or tilting the club head is a problem that can result in an uneven address to the ball. That is, the ball can be topped by a lifted club head at address. In accordance with the invention, the lines that project towards the eye of the golfer project an uneven width, should the level of the club head be slightly askew with respect to the surface of the green. Therefore, the width of the lines makes the player aware that the club head is or is not even with the putting green surface. In other words, the eyes of the player should be directly over the ball, as indicated by the equal width of the alignment lines. This added benefit is useful to those golfers who tend to lift the club head as they address the ball.

SUMMARY OF THE INVENTION

In accordance with the present invention, there is provided an improved golf putter having colored indicators for aligning the player's head with his or her club head of the putter, with the ball, and with the cup of the green. The colored indicators are a result of the unique shape of the club head of the putter. The club head has concave side surfaces. The lower portion of the club head extends slightly outwardly beyond the upper portion defining the concave arc. The concave surfaces are colored differently from the rest of the club head surfaces. For example, the concave surface can be white, and the other club head surfaces can be black. The difference in color contrast is visually distinguishable, perceived by the golfer as thin line indicators, despite the fact that there are no physical markings. A golfer standing over the top of the club head sees at least one pair of thinly colored lines along each surface of the club head parallel to the putting line side. This is a result of the lower projecting surface. Although there is no actual marker or groove forming a line, the golfer nonetheless visualizes lines on the sides of the club head, and is able to use these lines to aid in aligning his or her head with the club face, the ball, and the cup of the green.

It is an object of this invention to provide an improved golf putter.

It is another object of the invention to provide a golf putter having visual means by which a golfer can align his head relative to the club face of the putter, the ball, and the cup of the green.

It is a further object of this invention to provide a golf putter that has visual indicator markings for alignment that conform to golf association rules.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like elements and components of this invention will bear the same numbers and designations throughout the drawings.

DESCRIPTION OF THE PREFERRED EMBODIMENT

Generally speaking, the invention features a golf putter whose club head has visual indicator guides for aligning the player's head with the club head, with the ball, and with the cup of the putting green. The visual indicator guides are provided by distinguishable, colored surfaces of the club head that project the appearance of one or more pairs of alignment lines to the eye of the golfer, despite the fact that no actual markings exist. Thus, the indicator lines conform to golf rules of the USGA.

Figure 1A:
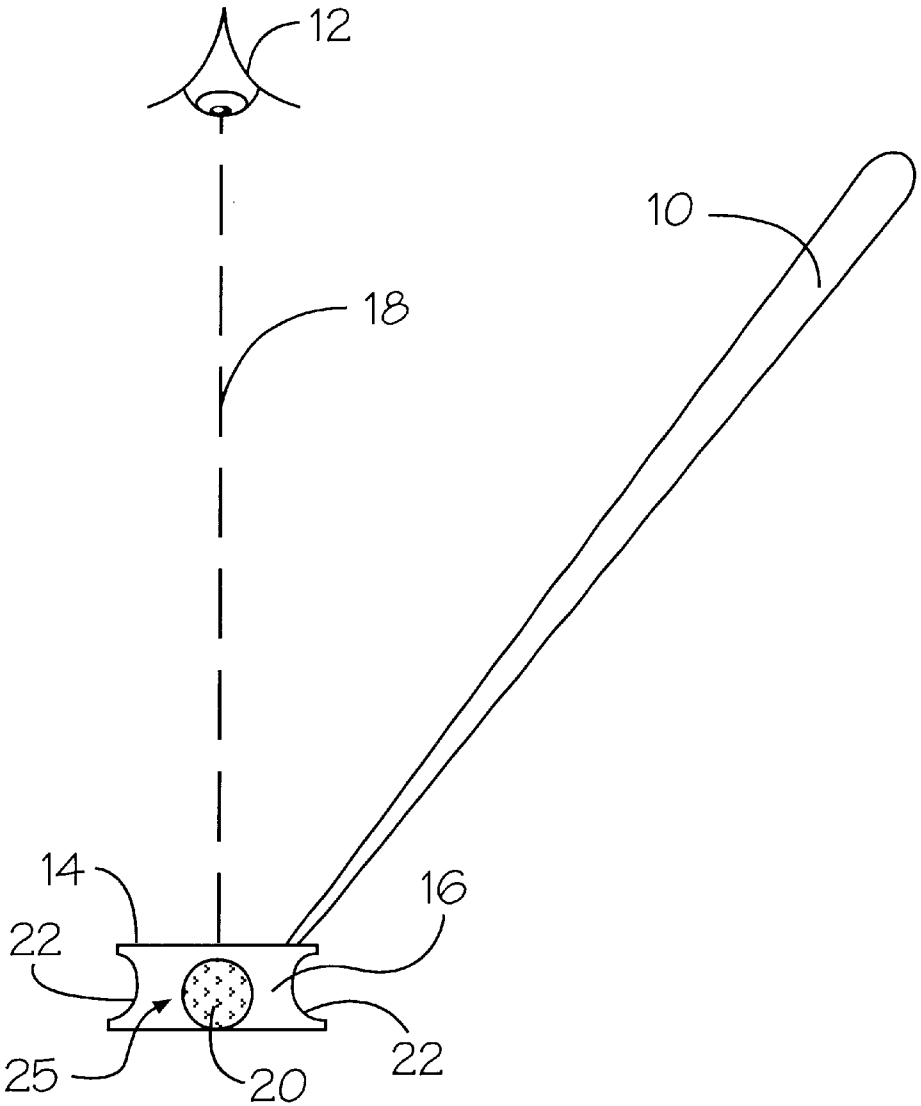
FIG. 1*a* illustrates a schematic view of the putter of this invention being aligned with a golf ball.

Now referring to FIG. 1*a*, the golf putter 10 of this invention is shown in situ, in a schematic view. An eye 12 of the golfer is positioned directly over the club head 16, and is visually aligned with the top surface 14 of the club head 16 of the golf putter 10, as shown by the line 18 depicting the line of sight of the golfer. The club head 16 is shown addressing the golf ball 20.

Figure 1B:
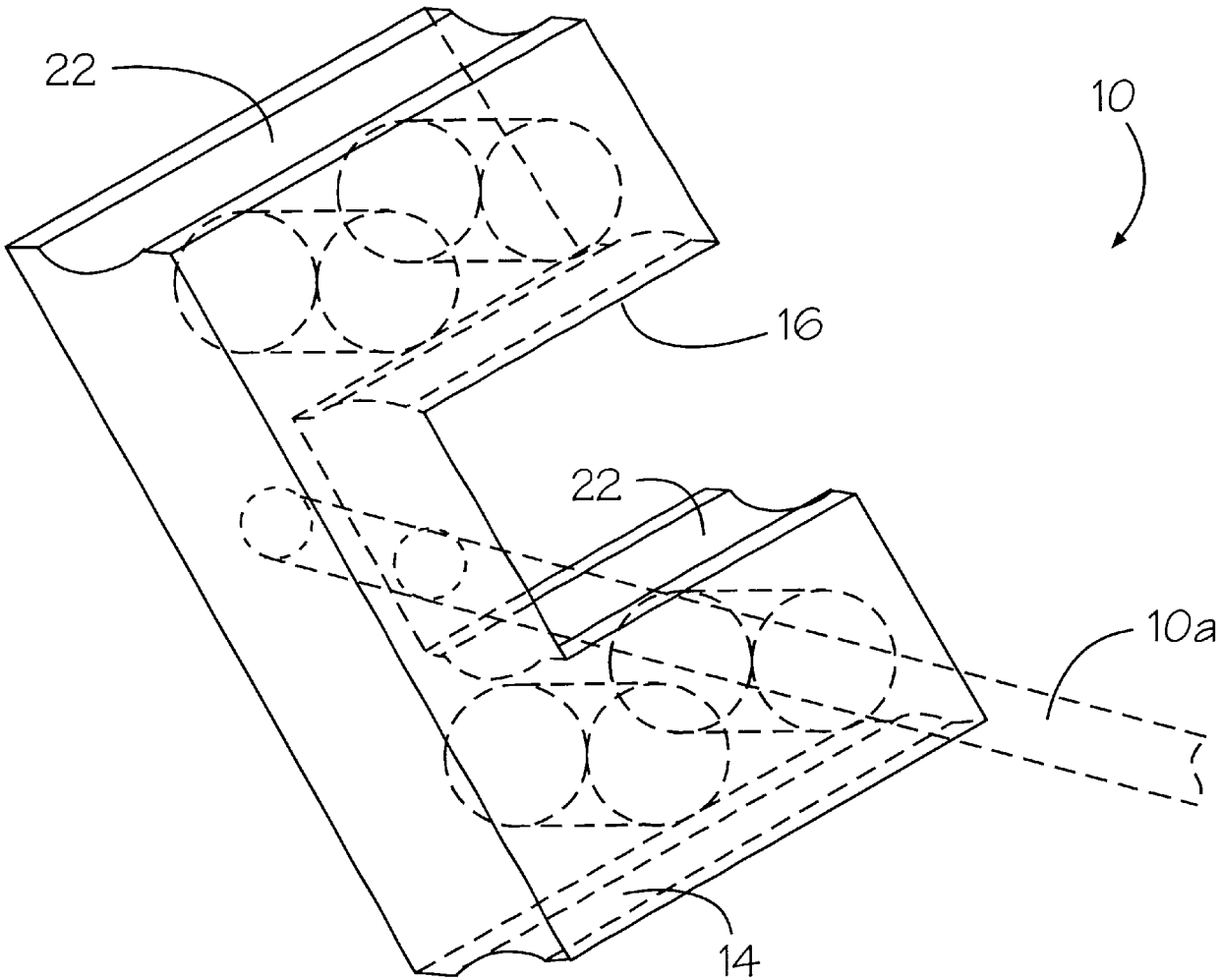
FIG. 1*b* is a perspective view of the putter head and portion of shaft attached thereto.

Referring now also to FIG. 1*b*, there is shown a perspective view of the putter head 16 and shaft 10*a* connected thereto. Concave surfaces are formed around the outer perimeter of the club head 16 and around the inner surfaces thereof, as described hereinbelow.

Figure 2A:
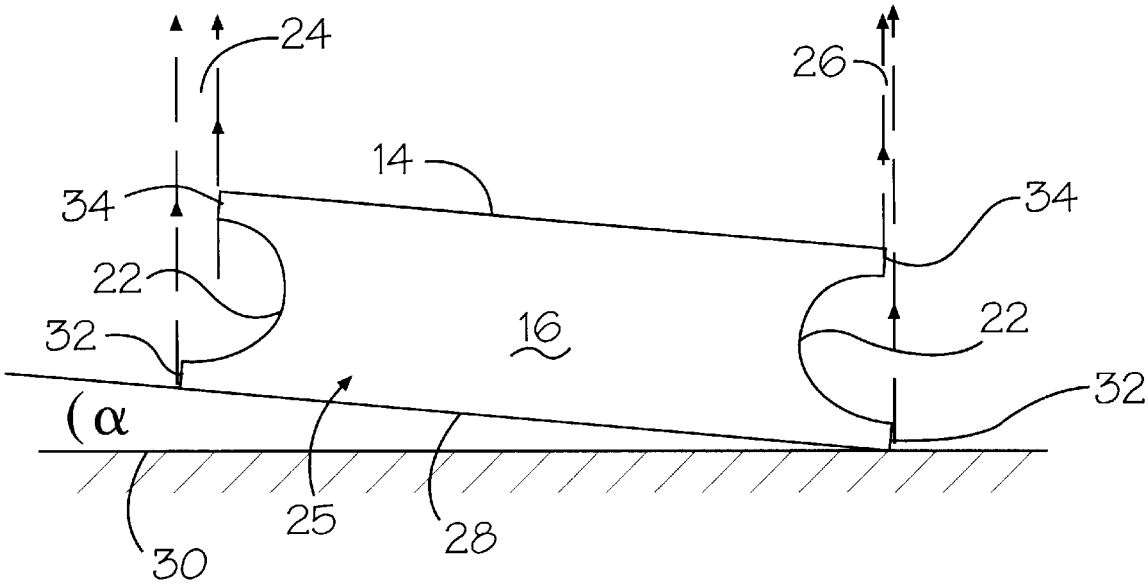
FIG. 2*a* depicts an enlarged front view of the club head of the putter shown in FIG. 1*a*, as lifted from the surface of the putting green through a small angle $\alpha$.
Figure 2B:
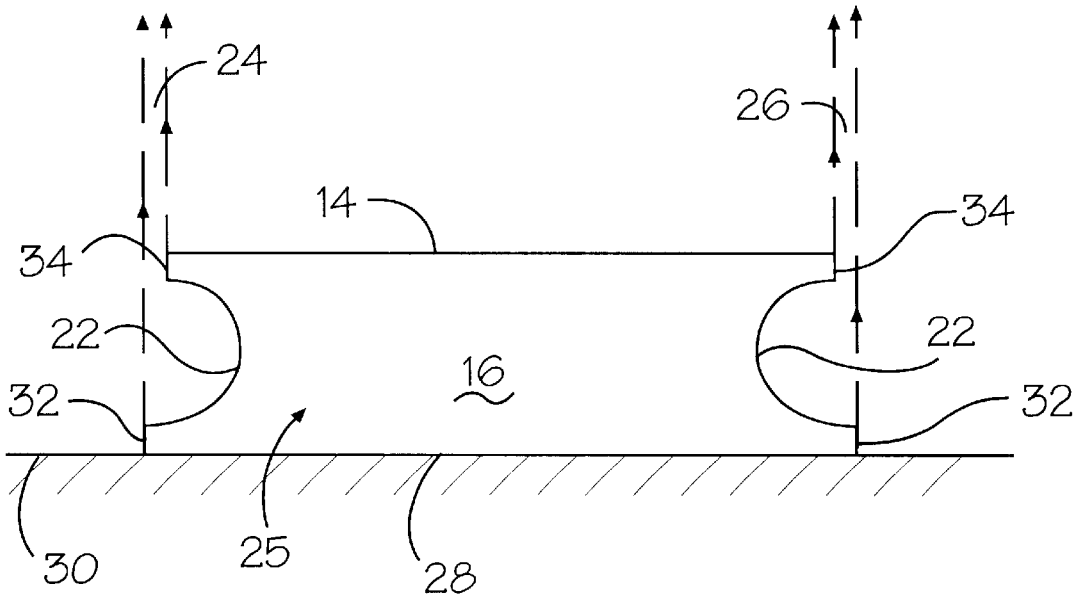
FIG. 2*b* shows the front view of the club head illustrated in FIG. 2*a*, as it lies even with the surface of the putting green.

Referring to FIGS. 2*a* and 2*b*, enlarged views of the club head 16 are illustrated. The club head 16 has two identical concave surfaces 22 formed in its outermost sides and around the cutout section of the club head 16. The concave surfaces 22 are colored white, while the top surface 14 is a dark color, or colored black. When properly viewed from above, as illustrated in FIG. 1*a*, the lighter concave surfaces 22 project what appears to be two thin lines 24 and 26, respectively, towards the eye 12 of the golfer. These lines 24 and 26 assist the golfer in aligning his or her head relative to the club face 25, the ball 20, and the cup or hole of the putting green (not shown here).

Referring to FIG. 2*a*, it is observed that the bottom surface 28 of the club head 16 has been lifted off of the surface 30 of the putting green, forming small angle $\alpha$. The result of this lift is indicated in the uneven width of projection lines 24 and 26.

When the bottom surface 28 of the club head 16 is even with the surface 30 of the putting green, the projection lines 24 and 26 are approximately the same width. Thus, the projection lines 24 and 26 have the dual purpose of aiding in aligning the player's head, as well as indicating how much lift results from the player's swing.

The alignment lines 24 and 26 appear, due to the end of the arcuate surface 22 at the bottom edge 32 projecting beyond the upper edge 34. Therefore, a golfer looking straight down at the club head 16, as in FIG. 1*a*, sees a thin white line on each side of the club head 16. Such a pair of lines appears along the golf head 16 at each surface parallel to the putting line.

Figure 3:
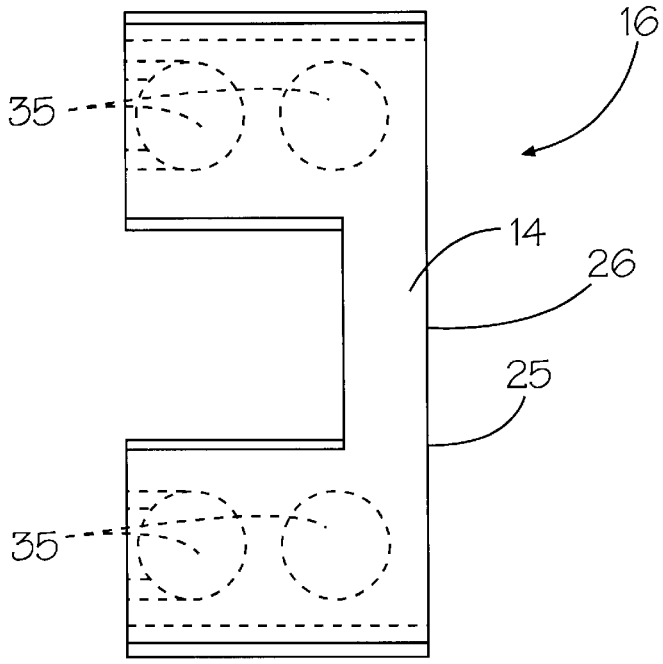
FIG. 3 illustrates a top view of the club head of the putter shown in FIGS. 1*a*, 2*a*, and 2*b*.
Figure 4:
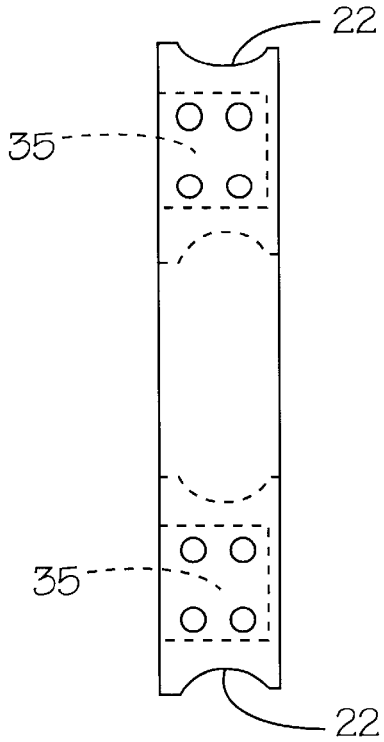
FIG. 4 depicts the front view of the club head of the putter shown in FIG. 3.
Figure 5:
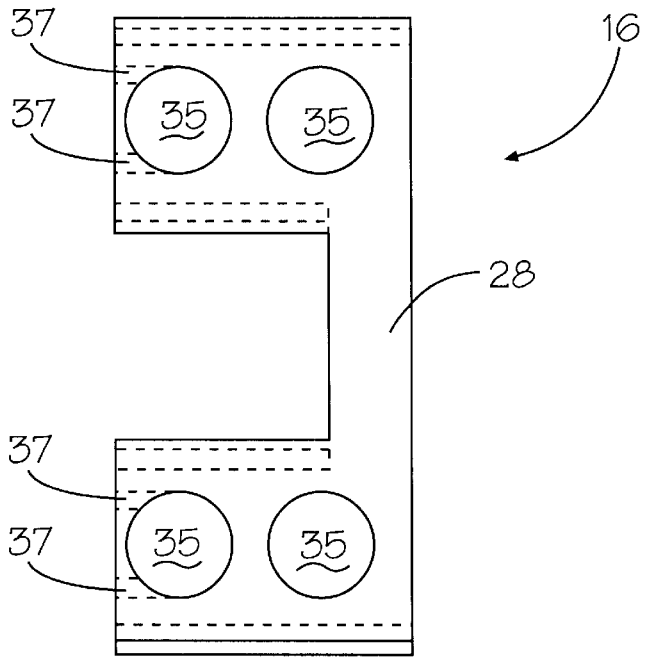
FIG. 5 illustrates a bottom view of the club head of the putter shown in FIG. 3.
Figure 6:
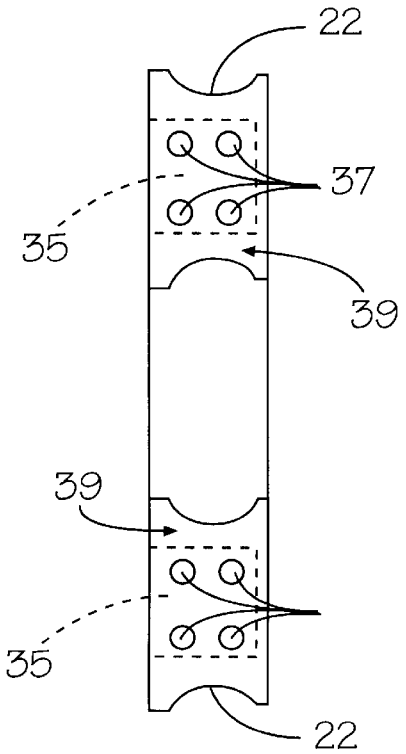
FIG. 6 shows the rear view of the club head of the putter shown in FIG. 3.

Referring to FIGS. 3 through 6, enlarged views of the club head 16 are shown for the top surface 14, front, bottom surface 28, and rear, respectively. The club head 16 can be fashioned with cut-out portions disposed within the bottom surface, for receiving removable balancing weights 35 in order to create a "sweet spot" 26 in the center of the club head 16, in the horizontal plane. Similarly, balancing weights of varying mass 37 can be added to cut-out portions of back surfaces 39 by the manufacturer or by the player, as shown in FIG. 6, in order to balance the club head in a perpendicular plane to the club face 25 (FIG. 3). The balancing weights 35 and 37 may be screwed into the club head 16 and/or secured thereto by set screws (not shown) or by any other securing technique known to those skilled in the art. If an adhesive is used for such securing process, for example, the melting point of the adhesive can be chosen to allow the player to heat the club head 16, when desired, in order to remove and/or replace the weights 35 and 37 with others of different mass.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A golf putter having a club head having a front club face, top and bottom surface portions, a back portion, and right and left sides, said right and left sides each being characterized by an arcuate surface, said arcuate surface being of a different color from said top surface portion, said bottom and top surface portions each having edge portions, each of said edge portions of said bottom surface extending outwardly farther than each of said edge portions of said top surface, whereby said arcuate surfaces appear to project a line on respective right and left sides that can be used to align a player's head with said club head, with a golf ball, and with a hole in a putting green.

2. The golf putter in accordance with claim 1, wherein said arcuate surfaces comprise a substantially light color, and the top surface portion comprises a dark color or black.

3. A golf putter having a club head having a front club face, top and bottom surface portions, a back portion, and right and left sides, said right and left sides each being characterized by an arcuate, opaque, concave surface, said arcuate, opaque, concave surface being of a different color from said top surface portion, sections of said arcuate, opaque, concave surfaces projecting a line to the head of a golfer standing directly above said top surface position that can be used to align said golfer's head to said club head so that a player can see the lowermost portion of said club head from above.

4. The golf putter in accordance with claim 3, wherein said arcuate, opaque, concave surfaces comprise a substantially light color, and the top surface portion comprises a dark color or black.

5. A golf putter having a club head having a front club face, top and bottom surface portions, a back portion, an interior cut-out portion, and right and left opaque, concave sides, said right and left opaque, concave sides and said interior cut-out portion being characterized by a light colored side surface, said light colored, opaque, concave side surface being of different color from said top surface portion, sections of said light colored opaque, concave side surfaces projecting a line to the eyes of a golfer standing directly above said top surface portion that can be used to align the head of said golfer with said club head so that a player can see the lowermost portion of said club head, from above.

6. The golf putter in accordance with claim 5, wherein said opaque, concave side surfaces comprise a substantially white color, and the top surface portion compromises a dark color or black.

7. The golf putter in accordance with claim 5, further comprising means for balancing said club head.

8. The golf putter in accordance with claim 7, wherein said means for balancing said club head comprise at least one balancing weight.

9. The golf putter in accordance with claim 8, wherein said at least one balancing weight is removable from said club head.

* * * * *